US007048470B2

(12) United States Patent
Anres

(10) Patent No.: US 7,048,470 B2
(45) Date of Patent: May 23, 2006

(54) GUIDE DEVICE IN AN OFFSHORE DRILLING INSTALLATION

(75) Inventor: Stéphane Anres, Versailles (FR)

(73) Assignee: Saipem S.A., Montigny Le Bretonneux (DE)

( * ) Notice: Subject to any disclaimer, the term of this patent is extended or adjusted under 35 U.S.C. 154(b) by 0 days.

(21) Appl. No.: 10/493,188

(22) PCT Filed: Oct. 21, 2002

(86) PCT No.: PCT/FR02/03596

§ 371 (c)(1),
(2), (4) Date: Apr. 20, 2004

(87) PCT Pub. No.: WO03/040515

PCT Pub. Date: May 15, 2003

(65) Prior Publication Data

US 2005/0002740 A1 Jan. 6, 2005

(30) Foreign Application Priority Data

Oct. 24, 2001 (FR) ..... 01 13710

(51) Int. Cl.
*E02F 5/10* (2006.01)
*E21B 7/04* (2006.01)

(52) U.S. Cl. ..... 405/163; 405/163; 175/7

(58) Field of Classification Search ..... 405/156, 405/161–165; 175/7

See application file for complete search history.

(56) References Cited

U.S. PATENT DOCUMENTS

| | | | | |
|---|---|---|---|---|
| 2,783,027 | A | 2/1957 | Gilbert | |
| 3,333,432 | A * | 8/1967 | Hale et al. | 405/164 |
| 3,685,479 | A | 8/1972 | Bruce | |
| 3,824,798 | A * | 7/1974 | Shiroyama et al. | 405/164 |
| 4,223,737 | A | 9/1980 | O'Reilly | |
| 4,812,079 | A * | 3/1989 | Johnson et al. | 405/164 |

FOREIGN PATENT DOCUMENTS

| | | |
|---|---|---|
| EP | 0 952 301 A1 | 10/1999 |
| FR | 2 027 067 | 12/1969 |
| JP | 53-118791 * | 10/1978 |

* cited by examiner

*Primary Examiner*—Sunil Singh
(74) *Attorney, Agent, or Firm*—Cohen, Pontani, Lieberman & Pavane

(57) ABSTRACT

A guide device suitable for use in an offshore drilling installation having at least one drilling riser extending from a floating support to the guide device on the seabed. The guide device includes a guide pipe in a buried position, wherein the guide pipe has a front end resting horizontally on the seabed, a curved intermediate portion buried in the subsoil of the seabed at a radius of curvature preferably being greater than 500 m, and an inclined substantially linear rear portion at the rear end of the guide pipe buried in the subsoil of the seabed at a given angle of inclination lying in the range 50° to 60°.

20 Claims, 6 Drawing Sheets

FIG.15
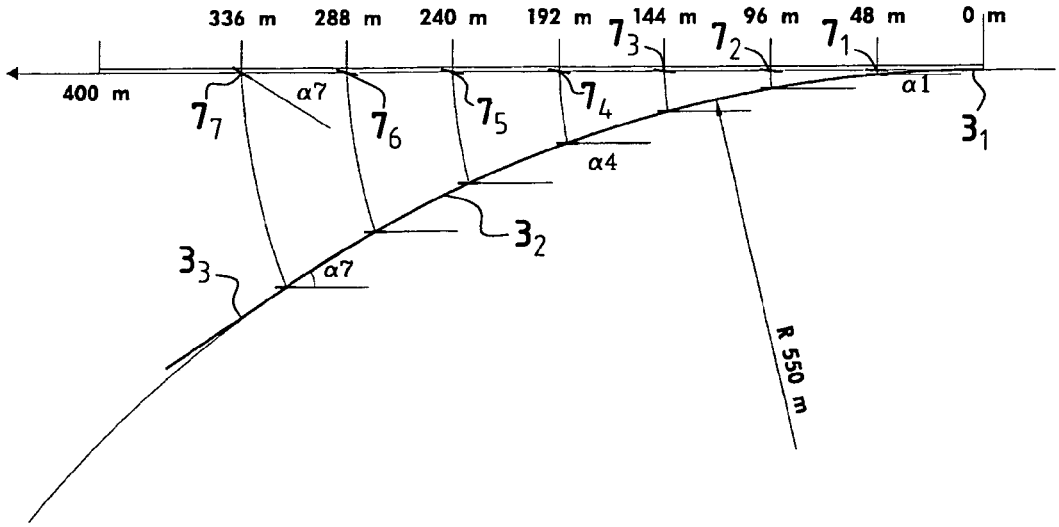
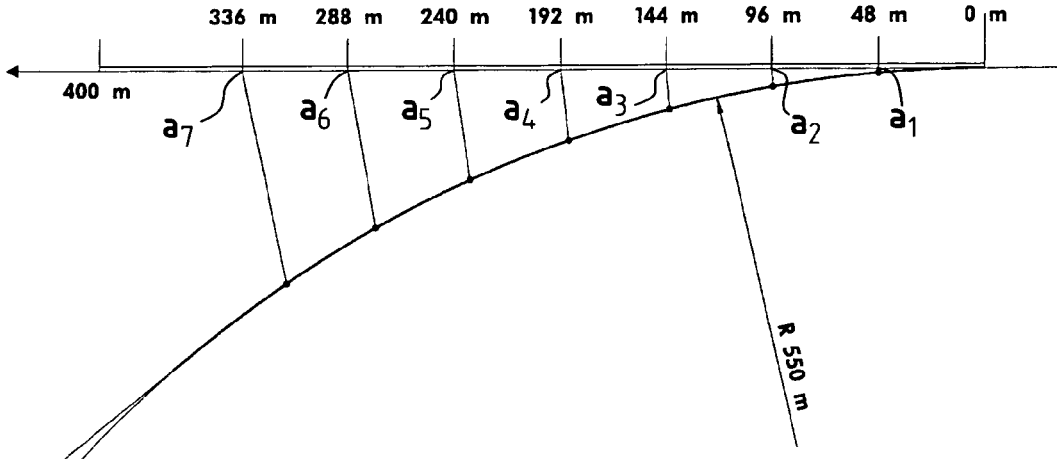
FIG.16

GUIDE DEVICE IN AN OFFSHORE DRILLING INSTALLATION

PRIORITY CLAIM

This is a U.S. national stage of application No. PCT/FR02/03596, filed on 21 Oct. 2002. Priority is claimed on that application and on the following application: Country: France, Application No.: 01/13710, Filed: 24 Oct. 2001.

BACKGROUND OF THE INVENTION

1. Field of the Invention

The present invention relates to the known field of offshore drilling from an anchored floating support on the surface, and more particularly it relates to seabed devices for guiding drill strings.

The invention relates more particularly to deflected drilling in deep water in order to reach points that are remote from vertically below the drilling equipment on the surface.

2. Discussion of Related Art

Once the depth of water becomes great, production fields and in particular oil fields are generally explored and operated from a floating support. As a general rule, the floating support has anchor means for keeping it in position in spite of the effects of current, winds, and the swell.

For drilling operations, it generally also has means for handling drill strings, such as guide equipment and associated safety systems installed on the seabed.

Wells are normally drilled vertically below the drilling equipment, and then they penetrate vertically into the ground over depths of several hundreds of meters. Thereafter, such wells are continued towards the oil deposit, referred to as a "reservoir", either in a vertical direction or else with the well being progressively deflected angularly so as to reach points of said reservoir that are remote to a greater or lesser extent.

By drilling a plurality of deflected wells in this way, it is possible to build up an array of wells in an umbrella shape extending from a common position for the floating support on the surface, thus making it possible to bring together all of the surface equipment in a single location throughout the time the field is being worked. Such installations are referred to dry tree units (DTU), i.e. well head units that are said to be "dry" because the well heads are brought together at the surface out of the water. This makes operation much easier since it is possible to have access to any of the wells from the DTU in order to perform any control or maintenance operations on a well, and this continues to be true throughout the lifetime of an installation which may be as much as 20 years to 25 years, or even longer.

It is possible to drill such wells only if the reservoir is at great depth, e.g. 2000 meters (m) to 2500 m, since it is essential to have a vertical length of several hundreds of meters in the seabed prior to initiating deflection of the well with the radii of curvature of the pipework constituting a well being of the order of 500 m to 1000 m.

Patents EP 0 952 300 and EP 0 952 301 disclose methods and apparatuses enabling deflected wells to be bored while taking advantage of the depth of water to go as far as possible away from vertically beneath the drilling equipment and in order to rest on the seabed in a manner that is substantially tangential to the horizontal.

In those patents, the guide devices installed on the seabed penetrate into the ground and enable a borehole to start being drilled into the seabed at an inclination of given angle relative to the vertical. The guide device is connected to the drilling equipment via a pipe referred to as a "drilling riser" which guides the drill string that passes through it and which serves to raise the drilling mud and debris.

The guide element installed on the seabed must ensure that large radii of curvature of 500 m to 1000 m are complied with and consequently it must be of large dimensions, while nevertheless remaining very strong in order to be able to absorb the considerable forces that are generated by the drilling string which is also constrained to follow the same radius of curvature, thereby giving rise to very high levels of friction and to a risk of the assembly becoming destabilized during drilling.

In addition, the guide element of considerable dimensions and mass must be preinstalled in ultradeep water, i.e. in water having a depth of 1000 m to 2500 m, or even more.

More precisely, EP 0 952 301 discloses a guide device which comprises a pipe element referred to as a "conductor" which is the guide tube of the borehole deployed from the floating support through the drilling riser down to a structure referred to as a "skid" resting on the seabed. This skid structure holds and guides the conductor tube horizontally at a certain height above the seabed. Thereafter the conductor adopts a curve towards the seabed under the effect of its own weight. While it is being deployed, the conductor cooperates with drilling tools so as to become embedded in part in the seabed. Putting such a guide device into place and in particular putting the conductor into place from the floating support represents a major operating constraint. In addition, the guide device does not provide for any control over the curvature of the conductor. Furthermore, in order to comply with a large radius of curvature, in particular a radius greater than 500 m, it is necessary for the conductor to be deployed tangentially to the horizontal over several tens of meters beyond the support point which guides it on the skid structure.

Finally, no means are described in those patents for enabling said conductor to be put into place with a large radius of curvature as is necessary to ensure that the drill string, and above all the casing elements, can operate with a minimum amount of lateral friction within the pipe.

For a radius of 600 m, if the well head is at 2 m above the sea bottom, the conductor will reach the ground only 50 m further away, which means that a 50 m length of conductor is cantilevered out freely and unsupported, which is unacceptable since the conductor runs the risk of breaking or kinking with curvature that is too sharp since it is not controlled. Furthermore, the cantilever created in this way can be harmful to proper operation during drilling operations and indeed throughout the lifetime of the well which may exceed 25 years.

SUMMARY OF THE INVENTION

The problem of the present invention is thus to provide a guide device which can be put into place with a large radius of curvature in a manner that is reliable, i.e. in which it is possible to control curvature so that it takes up a large radius and in particular a radius greater than 500 m, said device being easy to make and to install.

To do this, the present invention provides a guide device suitable for use in an offshore drilling installation, in which installation at least one drilling riser extends from a floating support to said guide device on the seabed, said drilling riser deflecting progressively from a substantially vertical position at said floating support to a position that is substantially horizontal or tangential to the horizontal at the seabed, it being possible to carry out drilling from said floating support via said drilling riser and said guide device in such a manner that the borehole in the seabed starts at a given angle of inclination α relative to the horizontal that lies preferably in the range 5° to 60°, and more preferably in the range 25° to 45°, said guide device being characterized in that it comprises a guide pipe in a buried position wherein said guide pipe comprises in succession:

a front end resting substantially horizontally on the seabed;

a curved intermediate portion of guide pipe buried in the subsoil of the seabed with a large radius of curvature, said radius of curvature preferably being greater than 500 m, and preferably lying in the range 500 m to 1000 m; and a substantially linear rear portion sloping at the rear end of said guide pipe buried in the subsoil of the seabed at said given angle of inclination α;

said guide pipe co-operating with controlled burying means enabling said guide pipe to be buried in the seabed while said guide pipe is being towed along the seabed from its front end, going from an initial position in which said guide pipe rests entirely on the seabed in a substantially horizontal position, to a said buried position in the subsoil of the seabed.

The curvature of the guide pipe is thus formed by controlled burying of the guide pipe.

The means for burying the guide pipe enable the guide pipe to be curved with a large radius of curvature of desired and controlled value by burying the pipe, the radius of curvature depending on the characteristics and the arrangement of said burying means.

It will be understood that the inclined linear portion extends said curved portion tangentially, and it is the inclination of this linear portion which determines said angle α at which the borehole is started.

It will also be understood that the term "horizontal at the bottom of the sea" designates a position that is substantially horizontal, depending on the relief of the seabed.

In a particular embodiment, said guide pipe is of length lying in the range 100 m to 600 m, preferably in the range 250 m to 450 m, and said given angle of inclination α of the guide pipe lies in the range approximately 10° to 60°, and preferably in the range 25° to 45°. The desired curvature for the guide pipe then corresponds to an increase in inclination of about 1° per 10-meter length of pipe, i.e. a radius of curvature of about 560 m.

In a preferred embodiment, said front end is securely received in a socket comprising a load resting on a front bedplate such that said socket holds said front end of said guide pipe substantially horizontally on the seabed while it is being towed. Said socket prevents the front end of the guide pipe from being buried, and also prevents it from turning about an axis that is substantially horizontal and perpendicular to the traction axis.

The present invention also provides a method of implementing a guide device of the invention, the method being characterized in that the following steps are performed:

placing said guide pipe in a said initial position resting substantially horizontally and rectilinearly on the seabed, said guide pipe co-operating with said controlled burying means; and applying traction at the seabed to said front end of said guide pipe, preferably in the axial longitudinal direction of said guide pipe, towing it from said initial position to a said-buried position.

The present invention also provides an offshore drilling installation comprising a drilling riser extending from a floating support to a guide device of the invention to which said drilling riser is connected, said drilling riser progressively deflecting from a substantially vertical position at said floating support to a position that is substantially horizontal or tangential to the horizontal at the seabed, it being possible to perform drilling from said floating support via said drilling riser and said guide device in such a manner that the borehole starts in the, seabed at a given angle of inclination α relative to the horizontal, preferably lying in the range 10° to 80°.

The present invention also provides a method of making a drilling installation of the invention, characterized in that the following steps are performed:

making a guide device according to a method of the invention; and connecting at least one said drilling riser to said front end of the guide pipe resting on the seabed.

Finally, the present invention provides a method of drilling using a drilling installation of the invention, the method being characterized in that drilling operations are performed and a borehole is made by deploying drill strings that co-operate with drilling tools and with casing tubes via a said drilling riser and a said guide device buried in the seabed.

It will be understood more precisely that the drill string serves initially to deploy the drilling tools and subsequently to deploy the tube elements referred to as "casing tubes" which build up the borehole as drilling is taking place, and to put them into place in the seabed.

BRIEF DESCRIPTION OF THE DRAWINGS

Other characteristics and advantages of the present invention appear in the light of the following description of various preferred embodiments, given with reference to the following figures, in which:

FIGS. 15 and 16 are line diagrams showing the values of the angles $\alpha_i$ and the spacings of the deflectors for obtaining the desired curvature with respect to FIGS. 7 and 12 respectively.

DETAILED DESCRIPTION OF THE PRESENTLY PREFERRED EMBODIMENTS

Figure 1:
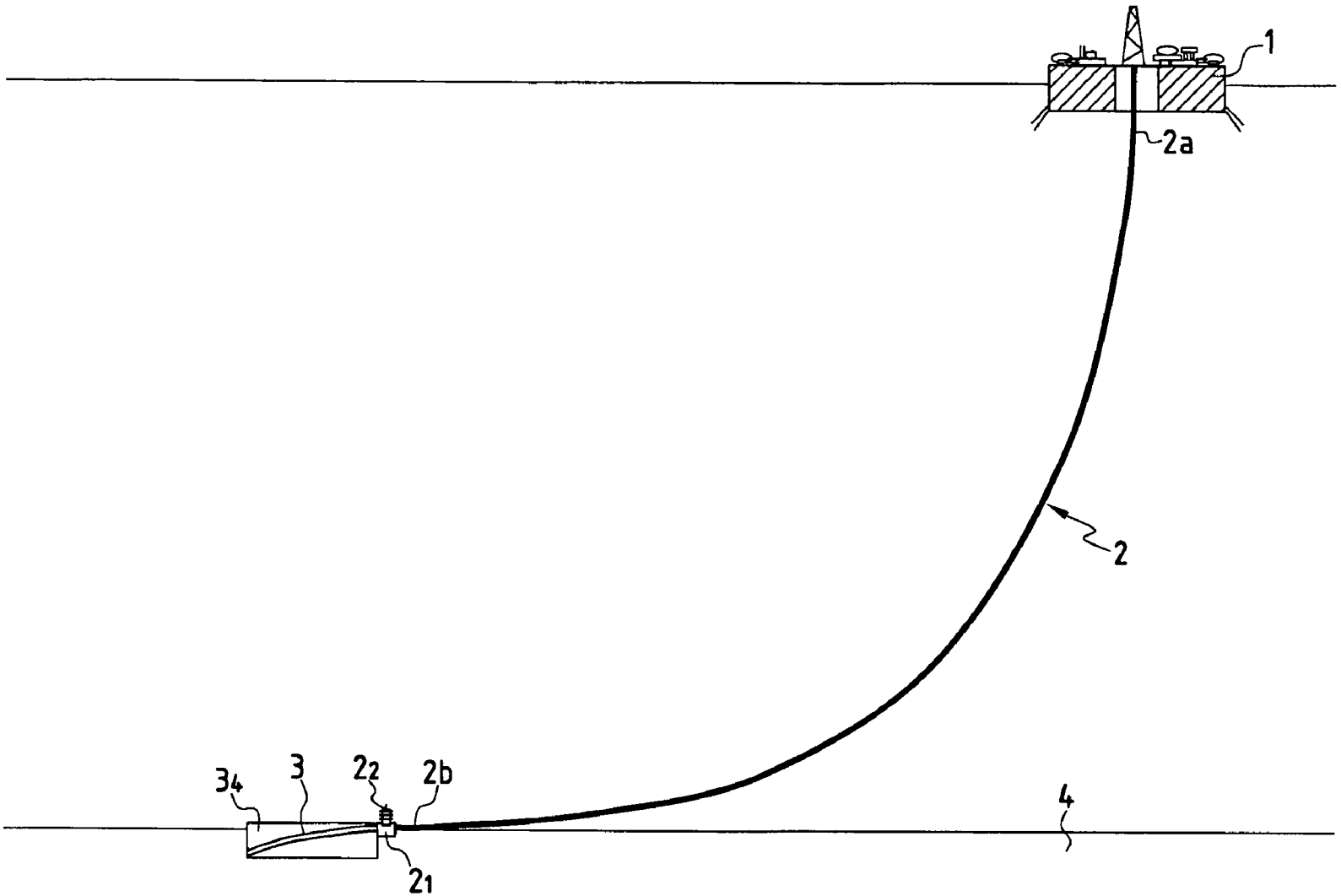
FIG. 1 is a side view of a DTU type surface support fitted with a drilling riser connected to a guide device preinstalled on the seabed.
Figure 5:
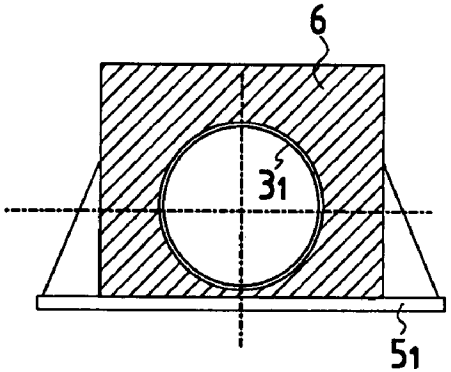
FIGS. 4 and 5 are cross-section views on respective section planes AA and BB through the guide device.
Figure 4:
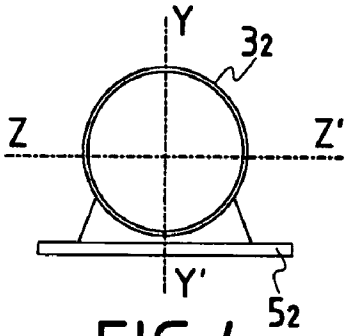

FIG. 1 is a side view of a surface support 1 of the DTU type fitted with drilling equipment and with treatment equipment. A drilling riser 2 in a catenary configuration is connected to a guide pipe 3 by means of an automatic undersea connector $\mathbf{2}_1$. The structure $\mathbf{3}_4$ represents means for achieving controlled burying. An offshore well control assembly $\mathbf{2}_2$ is associated with said well entrance and enables the well to be closed in the event of a blow out. Drilling is performed in conventional manner from the surface via the drilling riser 2 and the guide device 3–$\mathbf{3}_4$, until the reservoir is reached.

Said drilling riser 2 is deflected progressively from a substantially vertical position 2*a* at said floating support 1 to a position that is substantially horizontal or tangential to the horizontal at the seabed 2*b*, it being possible to perform drilling from said floating support 1 via said drilling riser 2 and said guide device 3 in such a manner that the borehole begins its path into the seabed at a given inclination $\alpha$ relative to the horizontal, where $\alpha$ preferably lies in the range 10° to 80°.

The controlled burying means $\mathbf{3}_4$, $\mathbf{5}_1$–$\mathbf{5}_3$, $\mathbf{7}_1$–$\mathbf{7}_3$, 8–9, and 13 enable said guide pipe 3 to be buried in the seabed while said guide pipe 3 is being towed T along the seabed from its front end $\mathbf{3}_1$:

- from an initial position A1 in which said guide pipe 3 rests entirely on the seabed in a substantially horizontal position;
- to a buried position A2 in the subsoil of the seabed, in which buried position said guide pipe 3 comprises in succession:
  - a front end $\mathbf{3}_1$ resting substantially horizontally on the seabed;
  - a curved intermediate portion of guide pipe buried in the subsoil of the seabed on a large radius of curvature, preferably a radius of curvature greater than 500 m; and
  - an inclined and substantially linear rear portion $\mathbf{3}_3$ at the rear end of said guide pipe 3 that is buried in the subsoil of the seabed, at said given angle of inclination $\alpha$.

EXAMPLE 1

In a first preferred embodiment of the invention, said controlled burying means comprise:

- a front bedplate $\mathbf{5}_1$ placed on the seabed and supporting said front end $\mathbf{3}_1$ of the guide pipe and secured thereto;
- at least one intermediate bedplate $\mathbf{5}_2$, $\mathbf{5}_3$ supporting said curved intermediate portion $\mathbf{3}_2$ and/or said rear portion $\mathbf{3}_3$ of said guide pipe and secured thereto, of area that is smaller than that of said front bedplate $\mathbf{5}_1$, and preferably a plurality of said intermediate bedplates $\mathbf{5}_2$, $\mathbf{5}_3$ distributed along said intermediate and rear portions $\mathbf{3}_2$, $\mathbf{3}_3$ of said guide pipe 3 with the areas thereof decreasing relative to that of the front bedplate with increasing proximity to said rear end $\mathbf{3}_3$ of the guide pipe; and
- an anchor 13 connected via a connection 12 to said rear end $\mathbf{3}_3$ and suitable for burying itself in the ground under the effect of said traction force being applied to said front end $\mathbf{3}_1$.

Figure 3:
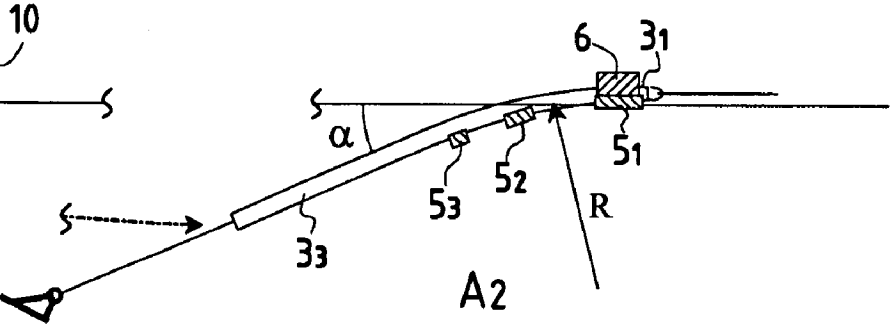
FIGS. 2 and 3 are side views of a guide device associated with an anchor for causing it to penetrate into the ground, shown respectively before and after penetrating into the seabed.
Figure 2:
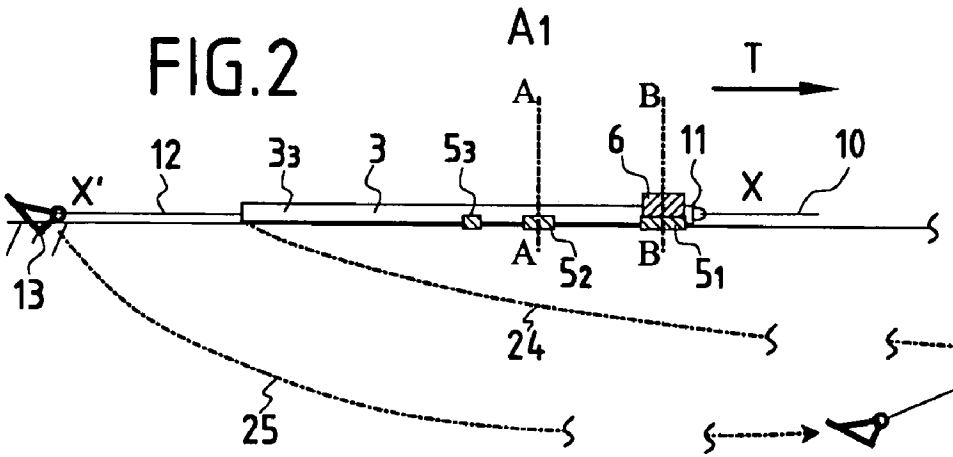

FIG. 2 shows this first version of the guide device of the invention in which the guide device is towed on site by means of a cable 10 connected to the front of the guide device by means of a traction head 11, the rear end of said guide device being connected via a second cable 12 to a very high performance anchor 13 of the Stevpriss® type or of the Stevmanta® type from the supplier Vryhoff (Holland). The front portion $\mathbf{3}_1$ of the guide device is secured to a bedplate $\mathbf{5}_1$ of large area resting on the seabed so as to limit penetration into the ground. In the same manner, the bedplates $\mathbf{5}_2$, $\mathbf{5}_3$ of smaller dimensions are distributed along the guide pipe, with the load bearing areas thereof decreasing with increasing proximity to the rear $\mathbf{3}_3$ of said guide pipe. In addition, the front $\mathbf{3}_1$ is stabilized by means of a socket comprising a load 6 secured to the bedplate $\mathbf{5}_1$ and thus receiving the guide device in said socket 6, as shown in FIG. 3.

By exerting traction on the towing cable 10, the assembly pulls the anchor so that it begins to bury itself 25, thereby pulling down 24 the rear end $\mathbf{3}_3$ of the guide pipe. The circular shape of the guide pipe constitutes only a moderate brake on penetration, whereas the bedplates $\mathbf{5}_2$, $\mathbf{5}_3$ distributed along it oppose penetration with a force that is proportional to their respective areas. Since the front bedplate $\mathbf{5}_1$ is of large dimensions, the front of the guide device remains on the surface and the deadweight 6 stabilizes the assembly in such a manner that the axis of the guide device remains substantially horizontal, and thus parallel to the seabed 4.

A method of making a guide device of the above type consists in applying traction to the front end $\mathbf{3}_1$ of said guide pipe 3 until said intermediate bedplates $\mathbf{5}_2$, $\mathbf{5}_3$ are buried into the ground at increasing depth on approaching the rear end $\mathbf{3}_3$ of the guide pipe so as to obtain the desired radius of curvature R, which radius is preferably greater than 500 m, preferably lying in the range 500 m to 1000 m.

EXAMPLE 2

Figure 8:
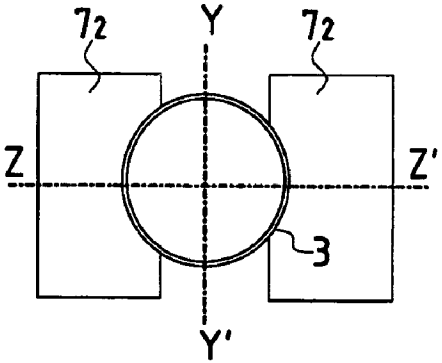
FIG. 8 is a left-hand end view of the FIG. 6 guide device, showing details of the side fins.
Figure 7:
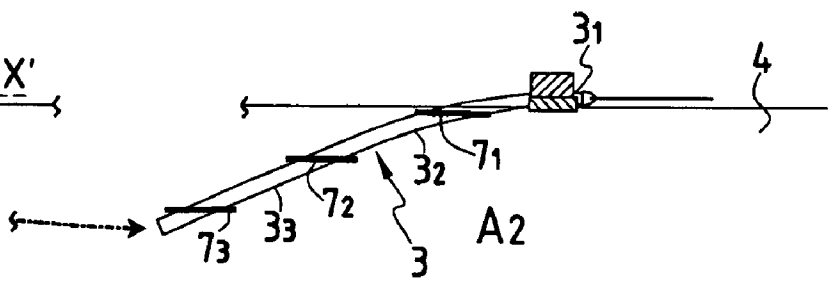
FIGS. 6 and 7 are side views of a guide device fitted with lateral fins for providing varying amounts of penetration into the ground, shown respectively before and after penetrating into the seabed.
Figure 6:
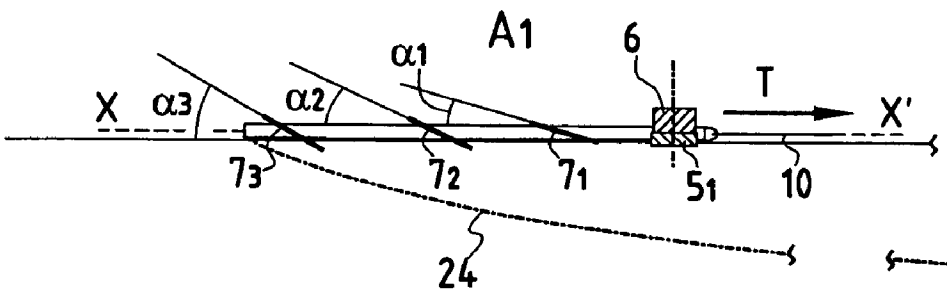

In another preferred embodiment of the invention, shown in FIGS. 6, 7, and 8, said controlled burying means comprise at least one deflector $\mathbf{7}_1$, $\mathbf{7}_2$, $\mathbf{7}_3$ secured to said guide pipe 3 in said intermediate portion 32 or said rear portion $\mathbf{3}_3$ of the guide pipe, the deflectors comprising plane surfaces that are preferably disposed symmetrically about a vertical axial plane XX', YY' of said guide pipe in the longitudinal direction when it is in a rectilinear horizontal position, and said plane surfaces of the deflectors are inclined relative to a horizontal axial plane XX', ZZ' of said guide pipe when it is in a horizontal position on the seabed, said deflector $\mathbf{7}_1$, $\mathbf{7}_2$, $\mathbf{7}_3$ being inclined at a respective angle $\alpha_1$, $\alpha_2$, $\alpha_3$ so as to cause said guide pipe to be buried when it is pulled from said substantially horizontal initial position A1 to a said buried position A2 in the seabed.

These deflectors $\mathbf{7}_1$, $\mathbf{7}_2$, $\mathbf{7}_3$ serve to control the curvature of the guide pipe buried in the seabed since, once said deflectors have moved into a horizontal position as shown in FIG. 7, they prevent any further burying of the pipe and stabilize it in the desired position A2. It will be understood that it is the spacing and the inclination $\alpha_i$ of the deflectors which determine the curvature and more generally the shape of the guide pipe in the buried position A2.

The guide device preferably comprises a plurality of deflectors $\mathbf{7}_i$ ($\mathbf{7}_1$–$\mathbf{7}_3$) distributed along said guide pipe and inclined at angles $\alpha_i(\alpha_1-\alpha_3)$ that become smaller as the corresponding deflector $7_i$ ($7_1$–$7_3$) is closer to said front end $3_1$.

The guide pipe is thus fitted with a plurality of deflectors $7_1$–$7_3$ secured to the guide pipe and oriented at angles $\alpha_1$–$\alpha_3$ relative to the axis XX' thereof. By way of example, the deflector $7_1$–$7_3$ is in the form of a simple plane metal sheet, preferably reinforced, and preferably symmetrical about the vertical axial plane XX', YY' and the horizontal plane XX', ZZ' of the guide pipe, being welded to the guide pipe of the guide device as shown in FIG. 8. This angle is previously adjusted during manufacture of the guide device so as to act in the same manner as the anchor 13 described with reference to FIGS. 2 and 3, i.e. so as to cause the guide pipe to become buried, with the depth of burial being limited by the angle $\alpha$. When traction T is applied to the tow cable 10, the deflector $7_1$–$7_3$ becomes buried, locally pulling down 24 the guide pipe until the deflector becomes substantially parallel to the traction force on the cable 10, i.e. substantially parallel to the seabed 4, or indeed substantially horizontal, in which position it no longer exerts any downward vertical force tending to move the assembly downwards.

A multitude of optionally identical deflectors $7_1$–$7_3$ are advantageously disposed along the guide device, each of them presenting a respective angle $\alpha_1$–$\alpha_3$ that becomes smaller on approaching the front end $3_1$ as shown in FIG. 6. Under such conditions, during penetration 24 into the ground, as soon as the set of deflectors $7_1$–$7_3$ has reached a substantially horizontal position, the desired curvature is obtained, as shown in FIG. 7.

A method of making a guide device in accordance with this second embodiment consists in applying traction T to the front end $3_1$ of said guide pipe 3 until said deflectors $7_1$, $7_2$, $7_3$ are buried into the ground so as to occupy respective horizontal positions, thereby obtaining said desired curvature which preferably has a radius of curvature greater than 500 m, and more preferably that lies in the range 500 m to 1000 m.

FIG. 15 is a line diagram of a guide pipe 3 that is 400 m long, resting initially horizontally on the seabed, and then shown in its buried position successively comprising a front portion $3_1$ in a straight configuration, a central portion $3_3$ in a curved configuration, and a substantially straight rear portion $3_3$, the pipe being fitted with burying means $7_i$ ($7_1$–$7_7$) as described with reference to FIG. 7. Said deflectors $7_i$ are spaced apart along said pipe and they are inclined at respective angles $\alpha_i$ relative thereto having the values given in Table 1 below, so as to obtain a radius of curvature R=500 m.

TABLE 1

| Deflector | $7_1$ | $7_2$ | $7_3$ | $7_4$ | $7_5$ | $7_6$ | $7_7$ |
|---|---|---|---|---|---|---|---|
| abscissa | 48 m | 96 m | 144 m | 192 m | 240 m | 288 m | 336 m |
| $\alpha_i$ | 2.5° | 5° | 75° | 10° | 12.5° | 15° | 17.5° |

EXAMPLE 3

Figure 9:
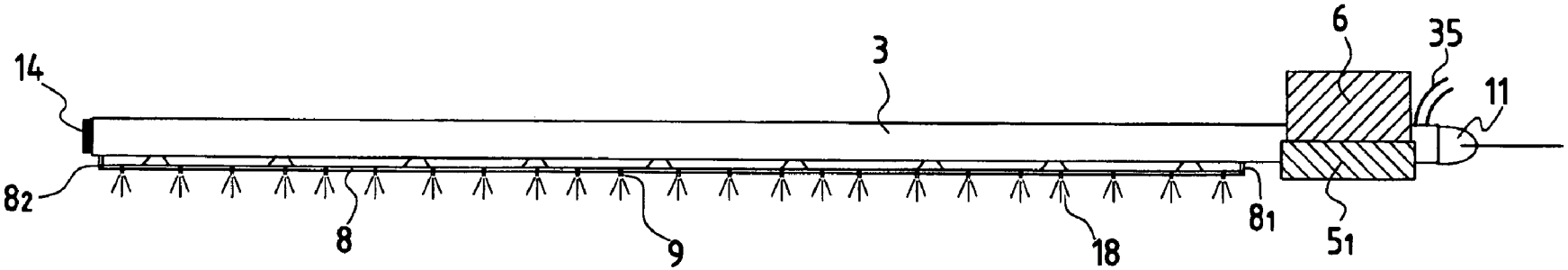
FIG. 9 is a side view of a guide device fitted with secondary jetting pipes to facilitate reducing cohesion with the ground during the stage of penetrating into the seabed.
Figure 10:
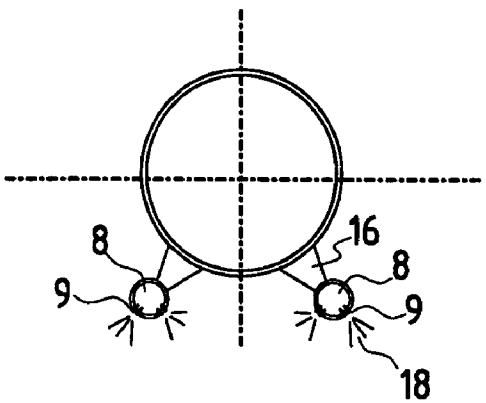
FIG. 10 is a cross-section view through a running portion of the FIG. 9 device.

FIGS. 9 and 10 show another preferred version of the invention in which said controlled burying means comprise:

- secondary pipes 8 for jetting fluid 18, said pipes being secured to said guide pipe 3, extending parallel thereto along the bottom thereof; and
- said secondary pipes 8 are smaller in diameter than the guide pipe 3 and have perforations 9 through their bottom faces, enabling a fluid 18 to be expelled downwards when said secondary pipes 8 are fed with a said fluid 18 under pressure.

Said secondary pipes 8 are preferably connected via their ends $8_1$, $8_2$ to the front and rear ends $3_1$, $3_3$ of said guide pipe and they communicate with said front and rear ends $3_1$, $3_3$ so as to enable a single feed pipe $3_5$ to feed them from said front end $3_1$ of said guide pipe 3.

In FIG. 10, there can be seen two secondary pipes 8 disposed symmetrically relative to the guide pipe 3.

In FIG. 9, the secondary pipe 8 is connected at both ends to the guide pipe 3 via respective non-return check valves $8_1$, $8_2$. Said guide pipe 3 itself hermetically closed at both ends, firstly by the traction head 11 and secondly by a plug 14. An orifice is connected via a water feed pipe 35 to the surface vessel 1 having the necessary pumping means. Thus, during towing, the guide pipe can be lightened by being filled with gas under pressure via the feed pipe, the excess pressure escaping via the check valves $8_1$, $8_2$ and then via the orifices 9 of the secondary pipe 8. Once the assembly has been placed on the seabed 4, the same pipes 8 are advantageously used to inject water under high pressure, thereby making the assembly heavier by filling the guide pipe 3 and then reducing the cohesion of the ground facing it, so as to make it easier to bury the guide pipe.

A method of making a guide device of the above type comprises the following steps:

- injecting gas under pressure into said secondary pipes 8 while the guide pipe 3 is to be towed over the seabed; and
- injecting a liquid under pressure, preferably water, into said secondary pipes 8 and preferably into said guide pipe 3 that is closed at its ends $3_1$, $3_2$ that are in communication with said ends $8_1$, $8_2$ of said secondary pipes 8 when it is desired to bury the guide pipe 3.

EXAMPLE 4

Figure 14:
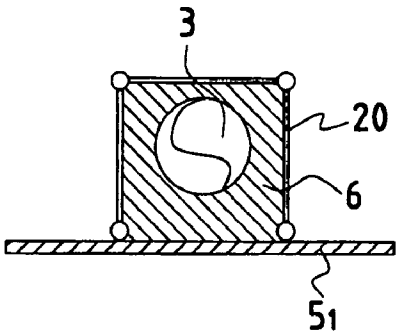
FIGS. 13 and 14 are sections on planes CC and DD of FIG. 11.

In another preferred version of the invention shown in FIGS. 11 to 14, a rigid external top structure 20 is advantageously associated with any one of the devices shown in FIGS. 2 to 10, said structure being secured to the front end $3_1$ of the guide pipe 3 that is received therein, the assembly resting on the ground via lateral bedplates 21, as shown in FIG. 14, which is a section on a plane DD.

More precisely, the guide device comprises:

- a rigid external top structure 20 covering said guide pipe 3 and holding it in a rectilinear configuration while it is substantially horizontal and resting on the seabed;
- said external structure 20 has a longitudinal central opening in its bottom face enabling said guide pipe 3 to be buried in the ground by being towed T; and
- at least one link $17_1$, $17_2$, $17_3$ connecting at least the rear portion $3_3$ of said guide pipe to said external structure 20 in such a manner as to prevent it from being buried to below a given depth so as to limit the curvature R of said curved portion;
- said external top structure 20 resting on the seabed 4, preferably via lateral bedplates 21 situated on either side of said longitudinal central opening 22, said lateral bedplates 21 preventing said rigid external structure 20 from being buried; and
- said external structure 20 being secured to said socket 6 in which said front portion $3_1$ of the guide pipe 3 is engaged.

Figure 13:
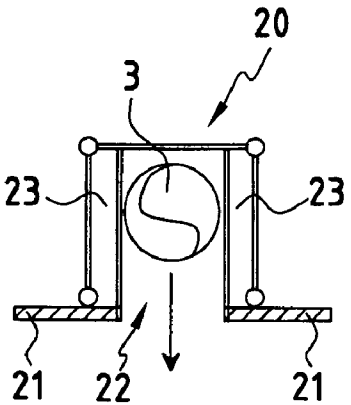

The running portion of the guide pipe is free to move vertically through the central opening 22 of the structure 20, as shown in FIG. 13 which is a section on plane CC, with structural elements 33 restricting any lateral displacement thereof.

The guide device preferably includes:

a plurality of flexible links $\mathbf{17}_1$, $\mathbf{17}_2$, $\mathbf{17}_3$ distributed along the guide pipe 3 and of length that increases on approaching the rear end $\mathbf{3}_3$ of the guide pipe 3, the lengths of the links being such that said guide pipe presents a curved portion of desired radius of curvature R followed by a said linear rear portion $\mathbf{3}_3$.

Figure 12:
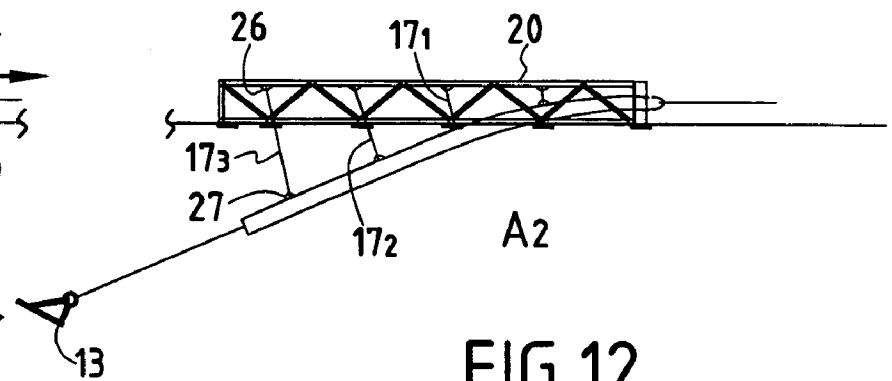
FIGS. 11 and 12 are side views of a structure associated with the guide device of FIGS. 2 and 3, for limiting depth of burial during penetration into the ground, respectively before and after penetrating into the seabed.
Figure 11:
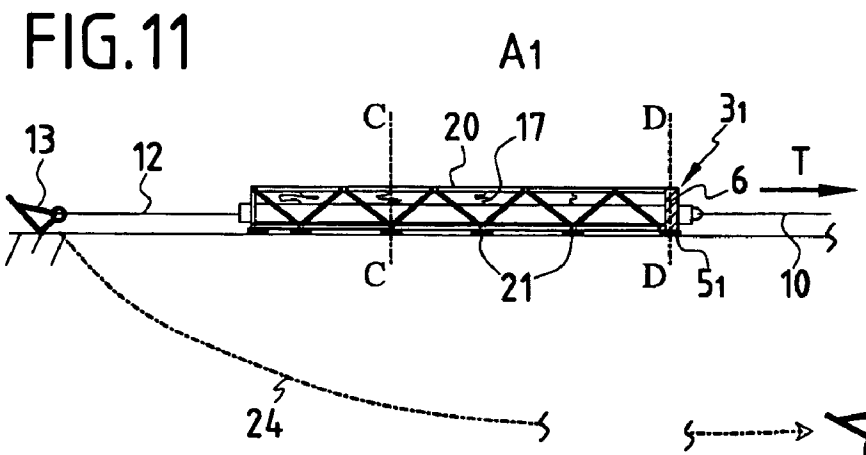

By way of example, these flexible links $\mathbf{17}_1$, $\mathbf{17}_2$, $\mathbf{17}_3$ are cables or chains connected firstly to the external structure 20 at 26 and secondly to the guide pipe at 27. Said connection points 26, 27 are shown in FIG. 12. The flexible links $\mathbf{17}_1$–$\mathbf{17}_3$ are distributed along the guide pipe in optionally uniform manner, and they are of varying length, decreasing on going towards the front end $\mathbf{3}_1$ of the guide pipe. Their positions and lengths are determined so that at the end of penetrating into the ground, when all of them are under tension, the desired curve is obtained as shown in FIG. 12. In order to prevent the structure 20 becoming buried in the ground, a multitude of lateral bedplates 21 are installed on its bottom face so as to establish sufficient support.

A method of making a guide device of this type consists essentially in applying traction T to the front end $\mathbf{3}_1$ of said guide pipe 3 and to said rigid external structure 20 secured to said guide pipe until said link(s) $\mathbf{17}_1$–$\mathbf{17}_3$ prevent further penetration of at least said rear portion $\mathbf{3}_3$ of said guide pipe so as to obtain the desired curvature, preferably having a radius of curvature R greater than 500 m, and more preferably lying in the range 500 m to 1000 m.

FIG. 16 is a line diagram showing a guide pipe 3 of length 400 m fitted with burying means of the kind shown in FIG. 12, the depth to which the guide pipe is buried being limited by a plurality of flexible links $\mathbf{17}_i(\mathbf{17}_1$–$\mathbf{17}_7)$ connecting said pipes at points $\alpha_i$ to the framework of the structure 20 (not shown). Table 2 below gives values for the lengths $l_i$ and for the spacings of said flexible links $\mathbf{17}_i$ corresponding, by way of example, to the pipe being curvature with a radius R=550 m.

TABLE 2

| Point No. | $\alpha_1$ | $\alpha_2$ | $\alpha_3$ | $\alpha_4$ | $\alpha_5$ | $\alpha_6$ | $\alpha_7$ |
|---|---|---|---|---|---|---|---|
| abscissa | 48 m | 96 m | 144 m | 192 m | 240 m | 288 m | 336 m |
| $l_i$ | 2.1 m | 8.4 m | 18.8 m | 33.4 | 52.1 | 74.8 | 101.6 |

All of these controlled burying means $\mathbf{5}_1$–$\mathbf{5}_3$, $\mathbf{7}_1$–$\mathbf{7}_3$, 13, 20, $\mathbf{17}_1$–$\mathbf{17}_3$ of the invention as described with reference to Examples 1 to 4 above can be implemented either individually or in combination, with the nature of the ground requiring extremely powerful means to be used if it presents a high degree of cohesion.

As an illustration, the guide pipe 3 may have a diameter lying in the range 0.40 m to 0.76 m (16" to 30") and may be about 200 m to 400 m long giving a weight of 30 tonnes (t) to 80 t. The external structure 20 is preferably continuous along the guide pipe and has additional weight of 25 t to 75 t. Jetting is performed using pressurized water from the surface, the pressure in the secondary pipes 8 being in range 20 bars to 100 bars.

The invention claimed is:

1. An offshore drilling installation, comprising at least one drilling riser extending from a floating support to a guide device on the seabed, said drilling riser deflecting progressively from a substantially vertical position at said floating support to a position that is one of substantially horizontal and tangential to the horizontal at the seabed, being characterized in that said guide device comprises a guide pipe in a buried position wherein said guide pipe comprises in succession:

a front end resting substantially horizontally on the seabed;

a curved intermediate portion of guide pipe buried in the subsoil of the seabed with a radius of curvature being greater than about 500 m; and a substantially linear rear portion sloping at the rear end of said guide pipe buried in the subsoil of the seabed at a given angle of inclination $\alpha$ relative to the horizontal that lies in the range of about 10° to 80°; and controlled burying means for burying said guide pipe in the seabed while said guide pipe is being towed along the seabed from its front end, going from an initial position in which said guide pipe rests entirely on the seabed in a substantially horizontal position, to asaid buried position in the subsoil of the seabed.

2. An offshore drilling installation according to claim 1, characterized in that said guide pipe is of length lying in the range of about 100 m to 600 m.

3. An installation according to claim 2, wherein said guide pipe length is in the range of about 250 m to 450 m.

4. An offshore drilling installation according to claim 1, characterized in that said front end is securely received in a socket comprising a load resting on a front bedplate such that said socket is configured for holding said front end of said guide pipe substantially horizontally on the seabed while said guide pipe is being towed.

5. An offshore drilling installation according to claim 1, wherein said controlled burying means comprises:

a front bedplate placed on the seabed and supporting said front end of the guide pipe, and secured thereto;

at least one intermediate bedplate supporting one of said curved intermediate portion and the rear portion of said guide pipe and secured to said one of said curved intermediate portion and said rear portion, the area of the intermediate bedplate being smaller than that of said front bedplate; and an anchor connected to said rear end and suitable for burying itself into the ground under the effect of traction applied to said front end.

6. An installation according to claim 5, wherein said controlled burying means comprises a plurality of said intermediate bedplates distributed along said intermediate portion and along said rear portion of said guide pipe, the areas of said bedplates decreasing from said front bedplate with increasing proximity to said rear end of the guide pipe.

7. An offshore drilling guide installation according to claim 1, wherein said controlled burying means comprise at least one deflector secured to said guide pipe in one of said intermediate portion and said rear portion of said guide pipe, the deflector comprising plane surfaces that are symmetrical about a vertical axial plane of said guide pipe in the longitudinal direction when said pipe is in a rectilinear horizontal position, and said plane surfaces of the deflectors being inclined relative to a horizontal axial plane of said guide pipe when it is in the horizontal position on the seabed, each of said deflectors being inclined at a respective angle in such a manner as to cause said guide pipe to become buried when towed from said substantially horizontal initial position to a said buried position in the seabed.

8. An offshore drilling installation according to claim 7, which comprises a plurality of deflectors distributed along said guide pipe and inclined at angles that decrease with increasing proximity of said deflector to said front end.

9. An offshore drilling installation according to claims 1, wherein said controlled burying means comprises:

secondary pipes for jetting fluid, the secondary pipes being secured to said guide pipe, extending parallel thereto, and beneath its bottom face; and said secondary pipes are smaller in diameter than the guide pipe and have perforations in their bottom walls, said secondary pipes being configured for expelling a fluid downwards when said secondary pipes are fed with a said fluid under pressure.

10. An offshore drilling installation according to claim 9, wherein said secondary pipes are connected via their ends to said front and rear ends of said guide pipe and communicate with said front and rear ends in such a manner as to make it possible to feed them via a common feed pipe from said front end of said guide pipe.

11. An offshore drilling installation according to claim 1, wherein the guide device comprises:

a rigid external top structure covering and holding said guide pipe in a rectilinear position while it is substantially horizontal and resting on the seabed;

said external structure having a longitudinal central opening in its bottom face configured for enabling said guide pipe to bury itself into the ground when it is towed; and at least one link configured for connecting at least the rear portion of said guide pipe to said external structure in such a manner for preventing said guide pipe from becoming buried beyond a given depth so as to limit the curvature of said curved portion;

said external structure resting on the seabed via lateral bedplates situated on either side of said longitudinal central opening, said lateral bedplates preventing said rigid external structure from becoming buried; and said external structure being secured to a socket in which said front end of the guide pipe is securely engaged.

12. An offshore drilling installation according to claim 11, which comprises a plurality of flexible links distributed along the guide pipe and of respective lengths that increase with increasing proximity to the rear end of the guide pipe and such that said guide pipe presents a said curved portion of the desired curvature followed by said linear rear portion.

13. An installation according to claim 1, wherein said radius of curvature is in the range of about 500 m to 1000 m.

14. An installation according to claim 1, wherein said given angle of inclination $\alpha$ of the guide pipe lies in the range of about 25° to 45°.

15. A method of making an offshore drilling installation according to claim 1, said method comprising the following steps:

placing said guide pipe in a said initial position resting substantially horizontally and rectilinearly on the seabed, said guide pipe co-operating with said controlled burying means; and applying traction at the seabed to said front end of said guide pipe, in the axial longitudinal direction of said guide pipe, towing it from said initial position to a said buried position; and connecting at least one said drilling riser at one end to said floating support and at the other end to said front end of said guide pipe so that said drilling riser deflects progressively from a substantial vertical position at said floating support to a position substantially horizontal or tangential to the horizontal at the seabed.

16. A method of making an installation according to claim 15, wherein said controlled burying means comprises a front bedplate placed on the seabed for supporting said front end of the guide pipe and secured thereto, at least one intermediate bedplate placed about one of said curved intermediate portion and the rear portion of said guide pipe and secured to said one of said curved intermediate portion and said rear portion, with the area of the intermediate bedplate being smaller than that of said front bedplate, an anchor connected to said rear end of the guide pipe and configured for burying itself into the ground under the effect of traction applied to said front end of the guide pipe, and traction is applied to the front end of said guide pipe until said intermediate bedplates are buried in the ground at depths that increase with increasing proximity to the rear end of the guide pipe so as to obtain the desired curvature in the range of about 500 m to 1000 m.

17. A method of making an installation according to claim 15, wherein said controlled burying means comprises at least one deflector secured to said guide pipe in one of said intermediate portion and said rear portion of said guide pipe, the deflector comprising plane surfaces that are symmetrical about a vertical axial plane of said guide pipe in the longitudinal direction when said pipe is in a rectilinear horizontal position, and said plane surfaces of the deflectors being inclined relative to a horizontal axial plane of said guide pipe when it is in the horizontal position on the seabed, each of said deflectors being inclined at a respective angle in such a manner as to cause said guide pipe to become buried when towed from said substantially horizontal initial position to a said buried position in the seabed, and traction is applied to the front end of said guide pipe until said deflectors are buried in the ground in respective horizontal positions so as to obtain said curvature.

18. A method of making an installation according to claim 15, wherein said controlled burying means comprises secondary pipes for jetting fluid, the secondary pipes being secured to said guide pipe, extending parallel thereto, and beneath its bottom face and having a diameter smaller than a diameter of said guide pipe, said secondary pipes having perforations in their bottom walls, said secondary pipes being configured for expelling a fluid downwards when said secondary pipes are fed with a said fluid under pressure, and the method comprises the further steps of:

injecting a gas under pressure into said secondary pipes when the guide pipe is to be towed along the seabed; and injecting a liquid under pressure into said secondary pipes and preferably into said guide pipe that is closed at its ends and that is in communication with said ends of said secondary pipes when it is desired to bury said guide pipe.

19. A method of making an offshore drilling installation according to claim 15, characterized in that said controlled burying means comprises a rigid external top structure covering and holding said guide pipe in a rectilinear position while it is substantially horizontal and resting on the seabed;

said external structure having a longitudinal central opening in its bottom face configured for enabling said guide pipe to bury itself into the ground when it is towed; and at least one link configured for connecting at least the rear portion of said guide pipe to said external structure in such a manner for preventing said guide pipe from becoming buried beyond a given depth so as to limit the curvature of said curved portion;

said external structure resting on the seabed via lateral bedplates situated on either side of said longitudinal central opening, said lateral bedplates preventing said rigid external structure from becoming buried; and said external structure being secured to a socket in which said front end of the guide pipe is securely engaged, and traction is applied to the front end of said guide pipe and of said rigid external structure secured to said guide pipe until said at least one link prevent any further penetration of at least said rear portion of said guide pipe so as to obtain the desired curvature having a radius of curvature greater than 500 m.

20. A method of drilling with a drilling installation according to claim 1, comprising the step of making a borehole by deploying drill strings that co-operate with drilling tools and with casing tubes via said drilling riser and said guide device buried in the seabed, so that the borehole in the seabed starts at said given inclination $\alpha$ relative to the horizontal.

* * * * *